US009781507B2

(12) United States Patent
Mäkinen et al.

(10) Patent No.: US 9,781,507 B2
(45) Date of Patent: Oct. 3, 2017

(54) AUDIO APPARATUS

(71) Applicant: Nokia Technologies Oy, Espoo (FI)

(72) Inventors: Jorma Mäkinen, Tampere (FI); Anu Huttunen, Tampere (FI); Mikko Tammi, Tampere (FI); Miikka Vilermo, Siuro (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/782,409

(22) PCT Filed: Apr. 8, 2013

(86) PCT No.: PCT/FI2013/050381

§ 371 (c)(1),
(2) Date: Oct. 5, 2015

(87) PCT Pub. No.: WO2014/167165

PCT Pub. Date: Oct. 16, 2014

(65) Prior Publication Data

US 2016/0044410 A1 Feb. 11, 2016

(51) Int. Cl.
*H04R 1/40* (2006.01)
*H04R 3/00* (2006.01)
(Continued)

(52) U.S. Cl.
CPC ..... *H04R 1/406* (2013.01); *H04R 3/005* (2013.01); *H04S 1/00* (2013.01); *G10L 21/0216* (2013.01);
(Continued)

(58) Field of Classification Search
CPC .... H04R 1/406; H04R 3/005; H04R 2420/07; H04R 2499/11; H04R 2203/12; H04R 2430/23; H04S 1/00; G10L 21/0216
(Continued)

(56) References Cited

U.S. PATENT DOCUMENTS

2001/0008559 A1 7/2001 Roo
2011/0135107 A1 6/2011 Konchitsky
(Continued)

FOREIGN PATENT DOCUMENTS

WO WO-2012/072787 A1 6/2012

OTHER PUBLICATIONS

International Search Report and Written Opinion received for corresponding Patent Cooperation Treaty Application No. PCT/FI2013/050381, dated Dec. 11, 2013, 10 pages.

*Primary Examiner* — Melur Ramakrishnaiah
(74) *Attorney, Agent, or Firm* — Harrington & Smith

(57) ABSTRACT

An apparatus comprising: an input configured to receive at least two groups of at least two audio signals; a first audio former configured to generate a first formed audio signal from a first of the at least two groups of at least two audio signals; a second audio former configured to generate a second formed audio signal from the second of the at least two groups of at least two audio signals; an audio analyzer configured to analyze the first formed audio signal and the second formed audio signal to determine at least one audio source and an associated audio source signal; and an audio signal synthesizer configured to generate at least one output audio signal based on the at least one audio source and the associated audio source signal.

21 Claims, 14 Drawing Sheets

(51) Int. Cl.
*H04S 1/00* (2006.01)
*G10L 21/0216* (2013.01)

(52) U.S. Cl.
CPC ..... *H04R 2203/12* (2013.01); *H04R 2420/07* (2013.01); *H04R 2430/23* (2013.01); *H04R 2499/11* (2013.01)

(58) Field of Classification Search
USPC ..... 381/26, 17–24, 63; 700/94
See application file for complete search history.

(56) References Cited

U.S. PATENT DOCUMENTS

| | | | | |
|---|---|---|---|---|
| 2011/0317041 | A1* | 12/2011 | Zurek ..... | H04R 1/406 348/240.99 |
| 2012/0019689 | A1* | 1/2012 | Zurek ..... | H04R 3/005 348/240.99 |
| 2012/0082322 | A1 | 4/2012 | Van Waterschoot et al. | |
| 2014/0029761 | A1* | 1/2014 | Maenpaa ..... | H04R 3/005 381/92 |

* cited by examiner

703

701

AUDIO APPARATUS

RELATED APPLICATION

This application was originally filed as Patent Cooperation Treaty Application No. PCT/FI2013/050381 filed Apr. 8, 2013.

FIELD

The present application relates to apparatus for spatial audio signal processing. The invention further relates to, but is not limited to, apparatus for spatial audio signal processing within mobile devices.

BACKGROUND

Spatial audio signals are being used in greater frequency to produce a more immersive audio experience. A stereo or multi-channel recording can be passed from the recording or capture apparatus to a listening apparatus and replayed using a suitable multi-channel output such as a multi-channel loudspeaker arrangement and with virtual surround processing a pair of stereo headphones or headset.

It would be understood that it is possible for mobile apparatus such as mobile phone to have more than two microphones. This offers the possibility to record real multichannel audio. With advanced signal processing it is further possible to beamform or directionally amplify or process the audio signal from the microphones from a specific or desired direction.

SUMMARY

Aspects of this application thus provide a spatial audio capture and processing which provides an optimal pick up and stereo imaging for the desired recording distance whilst minimizing the number of microphones and taking into account limitations in microphone positioning.

Furthermore noise can be reduced in all but the camera direction. In such embodiments as described herein even with limited demand to microphone positioning, it is possible to achieve stereo separation between the channels of the directional sound field.

According to a first aspect there is provided a method comprising: receiving at least two groups of at least two audio signals; generating a first formed audio signal from a first of the at least two groups of at least two audio signals; generating a second formed audio signal from the second of the at least two groups of at least two audio signals; analysing the first formed audio signal and the second formed audio signal to determine at least one audio source and an associated audio source signal; and generating at least one output audio signal based on the at least one audio source and the associated audio source signal.

The first group of the at least two audio signals may be a front left and back left microphone; and generating a first formed audio signal from a first of the at least two groups of at least two audio signals may comprise generating a virtual left microphone signal.

The second group of the at least two audio signals may be a front right and back right microphone; and generating a second formed audio signal from a second of the at least two groups of at least two audio signals may comprise generating a virtual right microphone signal.

Analysing the first formed audio signal and the second formed audio signal to determine at least one audio source and an associated audio source signal may comprise determining at least one source location.

The method may further comprise: receiving a source displacement factor; and processing the at least one source location by the source displacement factor such that the source location is displaced away from the audio mid-line by the source displacement factor.

Receiving a source displacement factor may comprise generating a source displacement factor based on a zoom factor associated with a camera configured to capture at least one frame image substantially when receiving the at least two groups of at least two audio signals.

Generating at least one output audio signal based on the at least one audio source and the associated audio source signal may comprise generating the at least one output audio signal based on the at least one audio source location.

Generating the at least one output audio signal based on the at least one audio source location may comprise: determining at least one output audio signal location; and audio panning the at least one audio source signal based on the at least one audio source location to generate the at least one output audio signal at the at least one output audio signal location.

Generating a first formed audio signal from a first of the at least two groups of at least two audio signals may comprise generating a first beamformed audio signal from the first of the at least two groups of at least two audio signals; and generating a second formed audio signal from the second of the at least two groups of at least two audio signals may comprise generating a second beamformed audio signal from the second of the at least two groups of at least two audio signals.

Generating a first formed audio signal from a first of the at least two groups of at least two audio signals may comprise generating a first mixed audio signal from the first of the at least two groups of at least two audio signals such that the first mixed audio signal create a first order gradient pattern with a first direction; and generating a second formed audio signal from the second of the at least two groups of at least two audio signals may comprise generating a second mixed audio signal from the second of the at least two groups of at least two audio signals such that the second mixed audio signal creates a further first order gradient pattern with a second direction.

According to a second aspect there is provided an apparatus comprising: means for receiving at least two groups of at least two audio signals; means for generating a first formed audio signal from a first of the at least two groups of at least two audio signals; means for generating a second formed audio signal from the second of the at least two groups of at least two audio signals; means for analysing the first formed audio signal and the second formed audio signal to determine at least one audio source and an associated audio source signal; and means for generating at least one output audio signal based on the at least one audio source and the associated audio source signal.

The first group of the at least two audio signals may be a front left and back left microphone; and the means for generating a first formed audio signal from a first of the at least two groups of at least two audio signals may comprise means for generating a virtual left microphone signal.

The second group of the at least two audio signals may be a front right and back right microphone; and the means for generating a second formed audio signal from a second of the at least two groups of at least two audio signals may comprise means for generating a virtual right microphone signal.

The means for analysing the first formed audio signal and the second formed audio signal to determine at least one audio source and an associated audio source signal may comprise means for determining at least one source location.

The apparatus may further comprise: means for receiving a source displacement factor; and means for processing the at least one source location by the source displacement factor such that the source location is displaced away from the audio mid-line by the source displacement factor.

The means for receiving a source displacement factor may comprise means for generating a source displacement factor based on a zoom factor associated with a camera configured to capture at least one frame image substantially when receiving the at least two groups of at least two audio signals.

The means for generating at least one output audio signal based on the at least one audio source and the associated audio source signal may comprise means for generating the at least one output audio signal based on the at least one audio source location.

The means for generating the at least one output audio signal based on the at least one audio source location may comprise: means for determining at least one output audio signal location; and means for audio panning the at least one audio source signal based on the at least one audio source location to generate the at least one output audio signal at the at least one output audio signal location.

The means for generating a first formed audio signal from a first of the at least two groups of at least two audio signals may comprise means for generating a first beamformed audio signal from the first of the at least two groups of at least two audio signals; and means for generating a second formed audio signal from the second of the at least two groups of at least two audio signals may comprise means for generating a second beamformed audio signal from the second of the at least two groups of at least two audio signals.

The means for generating a first formed audio signal from a first of the at least two groups of at least two audio signals may comprise means for generating a first mixed audio signal from the first of the at least two groups of at least two audio signals such that the first mixed audio signal create a first order gradient pattern with a first direction; and means for generating a second formed audio signal from the second of the at least two groups of at least two audio signals may comprise means for generating a second mixed audio signal from the second of the at least two groups of at least two audio signals such that the second mixed audio signal creates a further first order gradient pattern with a second direction.

According to a third aspect there is provided an apparatus comprising at least one processor and at least one memory including computer code for one or more programs, the at least one memory and the computer code configured to with the at least one processor cause the apparatus to at least: receive at least two groups of at least two audio signals; generate a first formed audio signal from a first of the at least two groups of at least two audio signals; generate a second formed audio signal from the second of the at least two groups of at least two audio signals; analyse the first formed audio signal and the second formed audio signal to determine at least one audio source and an associated audio source signal; and generate at least one output audio signal based on the at least one audio source and the associated audio source signal.

The first group of the at least two audio signals may be a front left and back left microphone; and generating a first formed audio signal from a first of the at least two groups of at least two audio signals may cause the apparatus to generate a virtual left microphone signal.

The second group of the at least two audio signals may be a front right and back right microphone; and generating a second formed audio signal from a second of the at least two groups of at least two audio signals may cause the apparatus to generate a virtual right microphone signal.

Analysing the first formed audio signal and the second formed audio signal to determine at least one audio source and an associated audio source signal may cause the apparatus to determine at least one source location.

The apparatus may further be caused to: receive a source displacement factor; and process the at least one source location by the source displacement factor such that the source location is displaced away from the audio mid-line by the source displacement factor.

Receiving a source displacement factor may cause the apparatus to generate a source displacement factor based on a zoom factor associated with a camera configured to capture at least one frame image substantially when receiving the at least two groups of at least two audio signals.

Generating at least one output audio signal based on the at least one audio source and the associated audio source signal may cause the apparatus to generate the at least one output audio signal based on the at least one audio source location.

Generating the at least one output audio signal based on the at least one audio source location may cause the apparatus to: determine at least one output audio signal location; and audio pan the at least one audio source signal based on the at least one audio source location to generate the at least one output audio signal at the at least one output audio signal location.

Generating a first formed audio signal from a first of the at least two groups of at least two audio signals may cause the apparatus to generate a first beamformed audio signal from the first of the at least two groups of at least two audio signals; and generating a second formed audio signal from the second of the at least two groups of at least two audio signals may cause the apparatus to generate a second beamformed audio signal from the second of the at least two groups of at least two audio signals.

Generating a first formed audio signal from a first of the at least two groups of at least two audio signals may cause the apparatus to generate a first mixed audio signal from the first of the at least two groups of at least two audio signals such that the first mixed audio signal create a first order gradient pattern with a first direction; and generating a second formed audio signal from the second of the at least two groups of at least two audio signals may cause the apparatus to generate a second mixed audio signal from the second of the at least two groups of at least two audio signals such that the second mixed audio signal creates a further first order gradient pattern with a second direction.

According to a fourth aspect there is provided an apparatus comprising: an input configured to receive at least two groups of at least two audio signals; a first audio former configured to generate a first formed audio signal from a first of the at least two groups of at least two audio signals; a second audio former configured to generate a second formed audio signal from the second of the at least two groups of at least two audio signals; an audio analyser configured to analyse the first formed audio signal and the second formed audio signal to determine at least one audio source and an associated audio source signal; and an audio signal synthesiser configured to generate at least one output audio signal based on the at least one audio source and the associated audio source signal.

The first group of the at least two audio signals may be a front left and back left microphone; and the first former may be configured to generate a virtual left microphone signal.

The second group of the at least two audio signals may be a front right and back right microphone; and the second former may be configured to generate a virtual right microphone signal.

The audio analyser may be configured to determine at least one source location.

The apparatus may further comprise: a source displacement input configured to receive a source displacement factor; and a source displacer configured to process the at least one source location by the source displacement factor such that the source location is displaced away from the audio mid-line by the source displacement factor.

The source displacement input may comprise a source displacement factor generator configured to generate a source displacement factor based on a zoom factor associated with a camera configured to capture at least one frame image substantially when receiving the at least two groups of at least two audio signals.

The audio signal synthesiser may be configured to generate the at least one output audio signal based on the at least one audio source location.

The audio signal synthesiser may comprise: an output location determiner configured to determine at least one output audio signal location; and an amplitude panner configured to pan the at least one audio source signal based on the at least one audio source location to generate the at least one output audio signal at the at least one output audio signal location.

The first audio former may comprise a first beamformer configured to generate a first beamformed audio signal from the first of the at least two groups of at least two audio signals; and the second former may comprise a second beamformer configured to generate a second beamformed audio signal from the second of the at least two groups of at least two audio signals.

The first audio former may comprise a first mixer configured to generate a first mixed audio signal from the first of the at least two groups of at least two audio signals such that the first mixed audio signal create a first order gradient pattern with a first direction; and the second audio former may comprise a second mixer configured to generate a second mixed audio signal from the second of the at least two groups of at least two audio signals such that the second mixed audio signal creates a further first order gradient pattern with a second direction.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For better understanding of the present application, reference will now be made by way of example to the accompanying drawings in which.

EMBODIMENTS

The following describes in further detail suitable apparatus and possible mechanisms for the provision of effective sound-field directional processing of audio recording for example within audio-video capture apparatus. In the following examples audio signals and processing is described. However it would be appreciated that in some embodiments the audio signal/audio capture and processing is a part of an audio-video system.

It would be understood that often the use of an apparatus attempts to produce a directional capture that emphasizes a direction relative to the apparatus, the direction can for example attempting to record or capture audio signals in the direction with the camera. For example recording in a noisy environment where the target signal is in the direction of the camera. Furthermore it would be understood that the recording or capturing of audio signals can be to generate a stereo or multichannel audio recording or a directional mono capture that may be stationary or dynamically steered towards a target.

As described herein mobile devices or apparatus are more commonly being equipped with multiple microphone configurations or microphone arrays suitable for recording or capturing the audio environment or audio scene surrounding the mobile device or apparatus. A multiple microphone configuration enables the recording of stereo or surround sound signals and the known location and orientation of the microphones further enables the apparatus to process the captured or recorded audio signals from the microphones to perform spatial processing to emphasise or focus on the audio signals from a defined direction relative to other directions.

As described herein the captured or recorded sound field can be processed by beamforming (for example array signal processing beamforming) to enable a capturing or recording of a sound field in a desired direction while suppressing sound from other directions. In some embodiments as described herein a directional estimation based on delays between the beamformer output channels can be applied. The beamformer output and directional estimation as described herein are then employed to synthetize the stereo or mono output.

However current design trends in mobile electrical devices or apparatus, small device size and large displays on the devices only permit microphone configurations which generate problems in recording and processing of the audio signal.

For example a smart phone with a camera is limited in both the number of microphones and their location. As additional microphones increase size and manufacturing cost microphones current designs 're-use' microphones for different applications. For instance, microphone locations at the 'bottom' and 'top' ends can be employed to pick up speech and reference noise in the hand-portable telephone application of the phone and these microphones reused in video/audio recording applications.

Figure 2:
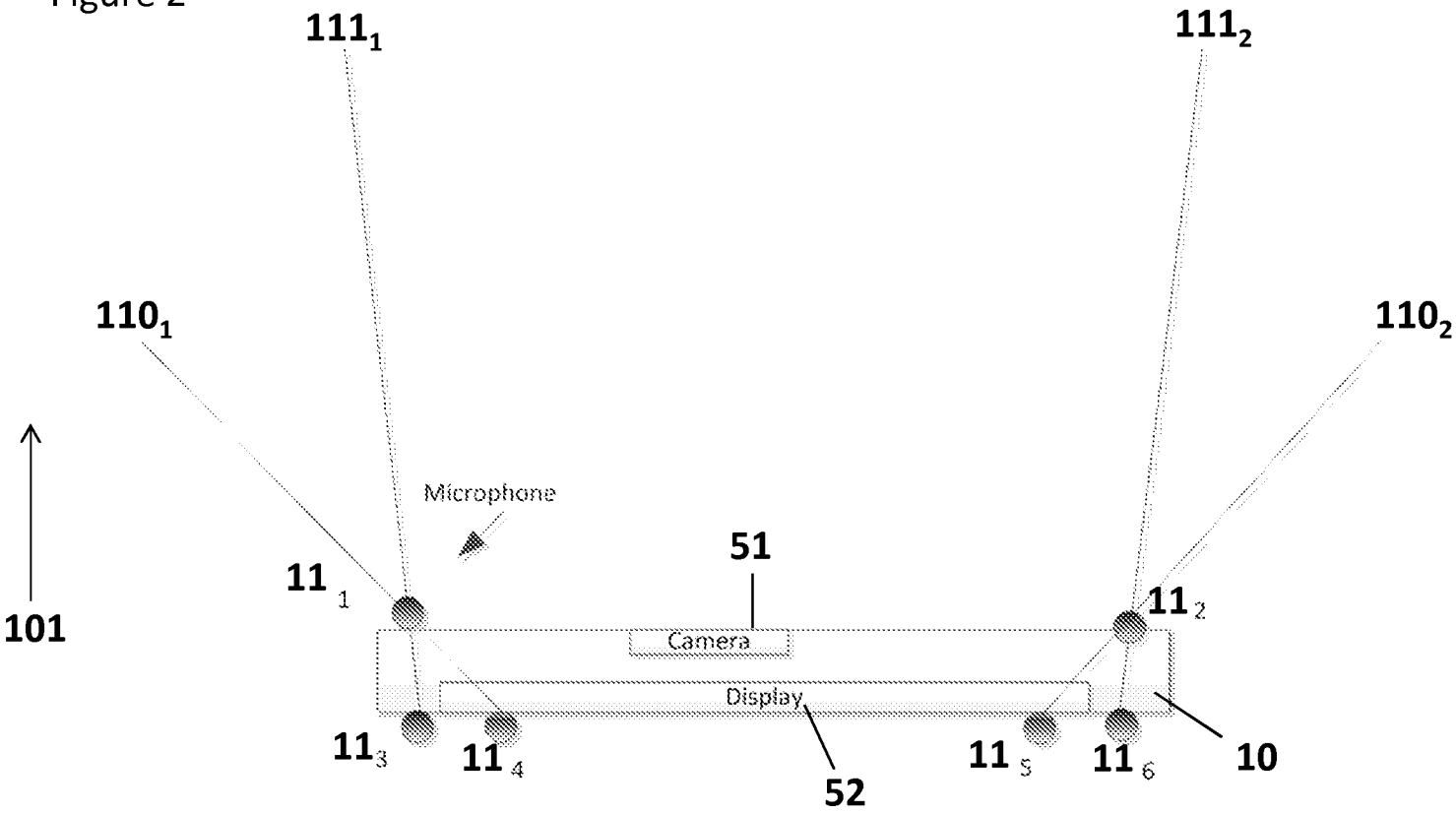
FIG. 2 shows schematically microphone locations on apparatus suitable for being employed in some embodiments.

It would be understood that to generate or design a 'beam' at least two microphones, preferably located in a line towards the desired beam direction, are used. FIG. 2 shows schematically an apparatus 10 which illustrates possible microphone locations providing stereo recording which emphasizes audio sources in a camera direction.

A first apparatus 10 configuration for example shows an apparatus with a camera 51 located on a 'front' side of the apparatus, a display 52 located on the 'rear' side of the apparatus. The apparatus further comprises left and right front microphones $\mathbf{11}_1$ and $\mathbf{11}_2$ located on the 'front' side near the 'left' and 'right' edges of the apparatus respectively. Furthermore the apparatus comprises left and right rear microphones $\mathbf{11}_4$ and $\mathbf{11}_5$ located on the 'rear' side and located away from the 'left' and 'right' edges but to the left and right of the centerline of the of the apparatus respectively.

According to this configuration microphones $\mathbf{11}_1$ and $\mathbf{11}_4$ could be used to provide a left beam and microphones $\mathbf{11}_2$ and $\mathbf{11}_5$ the right beam accordingly. Furthermore it would be understood that the lateral left-right' direction separation enables stereo recording for sound sources near to the camera. This can be shown by the left microphone pair $\mathbf{11}_1$ and $\mathbf{11}_4$ line $\mathbf{110}_1$ and the right microphone pair $\mathbf{11}_2$ and $\mathbf{11}_5$ line $\mathbf{110}_2$ defining a first configuration recording angle.

However such a configuration would be unsuitable in modern phone designs which target a minimum length and maximum screen size.

A second apparatus 10 configuration which is more suitable for modern phone designs show left and right front microphones $\mathbf{11}_1$ and $\mathbf{11}_2$ located on the 'front' side near the left' and 'right' edges of the apparatus respectively and the left and right rear microphones $\mathbf{11}_3$ and $\mathbf{11}_6$ located on the 'rear' side and located slightly further from the 'left' and 'right' edges but nearer the edges than the first configuration left and right rear microphones. The lateral left-right' direction separation in this configuration produces a much narrower recording angle defined by the left microphone pair $\mathbf{11}_1$ and $\mathbf{11}_3$ line $\mathbf{111}_1$ and the right microphone pair $\mathbf{11}_2$ and $\mathbf{11}_6$ line $\mathbf{111}_2$ defining a configuration recording angle.

Recording distant sound sources using the second configuration which employs the narrower recording angle would maximize the recording sensitivity of desired sound sources. Unfortunately, due to the narrow recording angle, the stereo effect is decreased and though the output consists of two channels, in practice it resembles mono recording. Furthermore, the audio track can sound contradictory when making a video recording with optical zoom, for example when the video is being replayed, the 'apparent' distance between the camera and the audio target would be shortened. Furthermore any audio target which appears on the left or right on the video may be heard from the centre due to the poor stereo separation.

Thus the concept as described herein in further detail is one which the audio recording system provides optimal pick up and stereo imaging for the desired recording distance whilst minimizing the number of microphones and taking into account limitations in microphone positioning.

These concepts are embodied by a directional capture method uses at least two pairs of closely spaced microphones where the outputs from the microphones are processed by first beamforming each pair of microphones to generate at least two audio beams and then audio source direction estimation based on delays between the audio beams.

Thus in some embodiments the beamforming can be employed to reduce noise in effectively all but the camera direction. Furthermore in some embodiments the beamforming can improve sound quality in reverberant recording conditions as the beamforming can filter out reverberation based on the direction sound is coming from. In some embodiments the application of correlation (or delay) based directional estimation is used to synthetize stereo or mono output from the beamformer output. In noisy conditions the application of beamforming can in some embodiments improve directional estimation by removing masking signals coming from directions other than the desired direction.

In some embodiments with respect to stereo recording the correlation based directional estimation furthermore enables the application of stereo separation processing to improve the faint stereo separation between the output channels, and thus generate suitable stereo sound even though a beamforming process modifies the focus to the front direction.

The correlation based method furthermore in some embodiments can receive the two beamed signals as inputs, representing left and right signal, removes the delays between signals and modifies the amplitudes of the left and right signals based on the estimated sound source directions. In such embodiments high quality directional capture or recordings can be generated with relatively relaxed requirements with respect to microphone positions (in other words with narrow lateral separation distances).

In some embodiments the processing or the audio capture or recording can be with regard to optical zooming while making a video. For example, in some embodiments where no zoom is being used the right and left channels can be panned to the same angles as they are estimated to be appearing from. When optical zoom is applied or is being used the left and right channels are panned wider than they really are with respect to the camera to reflect the angle between the camera and the target appears on the video.

Figure 1:
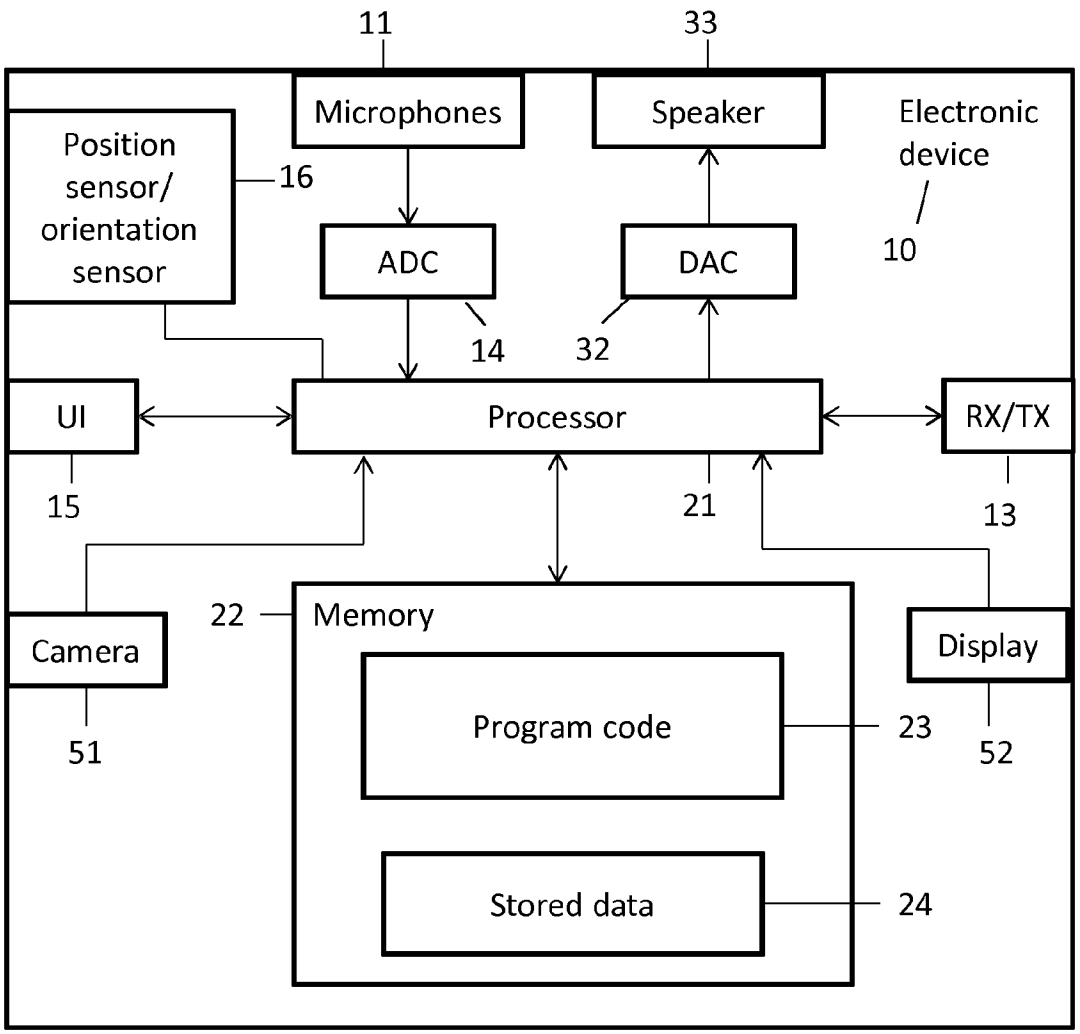
FIG. 1 shows schematically an apparatus suitable for being employed in some embodiments.

In this regard reference is first made to FIG. 1 which shows a schematic block diagram of an exemplary apparatus or electronic device 10, which may be used to record (or operate as a capture apparatus).

The electronic device 10 may for example be a mobile terminal or user equipment of a wireless communication system when functioning as the recording apparatus or listening apparatus. In some embodiments the apparatus can be an audio player or audio recorder, such as an MP3 player, a media recorder/player (also known as an MP4 player), or any suitable portable apparatus suitable for recording audio or audio/video camcorder/memory audio or video recorder.

The apparatus 10 can in some embodiments comprise an audio-video subsystem. The audio-video subsystem for example can comprise in some embodiments a microphone or array of microphones 11 for audio signal capture. In some embodiments the microphone or array of microphones can be a solid state microphone, in other words capable of capturing audio signals and outputting a suitable digital format signal in other words not requiring an analogue-to-digital converter. In some other embodiments the microphone or array of microphones 11 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or micro electrical-mechanical system (MEMS) microphone. The microphone 11 or array of microphones can in some embodiments output the audio captured signal to an analogue-to-digital converter (ADC) 14.

In some embodiments the apparatus can further comprise an analogue-to-digital converter (ADC) 14 configured to receive the analogue captured audio signal from the microphones and outputting the audio captured signal in a suitable digital form. The analogue-to-digital converter 14 can be any suitable analogue-to-digital conversion or processing means. In some embodiments where the microphones are 'integrated' microphones the microphones contain both audio signal generating and analogue-to-digital conversion capability.

In some embodiments the apparatus 10 audio-video subsystem further comprises a digital-to-analogue converter 32 for converting digital audio signals from a processor 21 to a suitable analogue format. The digital-to-analogue converter (DAC) or signal processing means 32 can in some embodiments be any suitable DAC technology.

Furthermore the audio-video subsystem can comprise in some embodiments a speaker 33. The speaker 33 can in some embodiments receive the output from the digital-to-analogue converter 32 and present the analogue audio signal to the user.

In some embodiments the speaker 33 can be representative of multi-speaker arrangement, a headset, for example a set of headphones, or cordless headphones.

In some embodiments the apparatus audio-video subsystem comprises a camera 51 or image capturing means configured to supply to the processor 21 image data. In some embodiments the camera can be configured to supply multiple images over time to provide a video stream.

In some embodiments the apparatus audio-video subsystem comprises a display 52. The display or image display means can be configured to output visual images which can be viewed by the user of the apparatus. In some embodiments the display can be a touch screen display suitable for supplying input data to the apparatus. The display can be any suitable display technology, for example the display can be implemented by a flat panel comprising cells of LCD, LED, OLED, or 'plasma' display implementations.

Although the apparatus 10 is shown having both audio/video capture and audio/video presentation components, it would be understood that in some embodiments the apparatus 10 can comprise only the audio capture and audio presentation parts of the audio subsystem such that in some embodiments of the apparatus the microphone (for audio capture) or the speaker (for audio presentation) are present. Similarly in some embodiments the apparatus 10 can comprise one or the other of the video capture and video presentation parts of the video subsystem such that in some embodiments the camera 51 (for video capture) or the display 52 (for video presentation) is present.

In some embodiments the apparatus 10 comprises a processor 21. The processor 21 is coupled to the audio-video subsystem and specifically in some examples the analogue-to-digital converter 14 for receiving digital signals representing audio signals from the microphone 11, the digital-to-analogue converter (DAC) 12 configured to output processed digital audio signals, the camera 51 for receiving digital signals representing video signals, and the display 52 configured to output processed digital video signals from the processor 21.

The processor 21 can be configured to execute various program codes. The implemented program codes can comprise for example audio-video recording and audio-video presentation routines. In some embodiments the program codes can be configured to perform audio signal processing.

In some embodiments the apparatus further comprises a memory 22. In some embodiments the processor is coupled to memory 22. The memory can be any suitable storage means. In some embodiments the memory 22 comprises a program code section 23 for storing program codes implementable upon the processor 21. Furthermore in some embodiments the memory 22 can further comprise a stored data section 24 for storing data, for example data that has been encoded in accordance with the application or data to be encoded via the application embodiments as described later. The implemented program code stored within the program code section 23, and the data stored within the stored data section 24 can be retrieved by the processor 21 whenever needed via the memory-processor coupling.

In some further embodiments the apparatus 10 can comprise a user interface 15. The user interface 15 can be coupled in some embodiments to the processor 21. In some embodiments the processor can control the operation of the user interface and receive inputs from the user interface 15. In some embodiments the user interface 15 can enable a user to input commands to the electronic device or apparatus 10, for example via a keypad, and/or to obtain information from the apparatus 10, for example via a display which is part of the user interface 15. The user interface 15 can in some embodiments as described herein comprise a touch screen or touch interface capable of both enabling information to be entered to the apparatus 10 and further displaying information to the user of the apparatus 10.

In some embodiments the apparatus further comprises a transceiver 13, the transceiver in such embodiments can be coupled to the processor and configured to enable a communication with other apparatus or electronic devices, for example via a wireless communications network. The transceiver 13 or any suitable transceiver or transmitter and/or receiver means can in some embodiments be configured to communicate with other electronic devices or apparatus via a wire or wired coupling.

The transceiver 13 can communicate with further apparatus by any suitable known communications protocol, for example in some embodiments the transceiver 13 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the apparatus comprises a position sensor 16 configured to estimate the position of the apparatus 10. The position sensor 16 can in some embodiments be a satellite positioning sensor such as a GPS (Global Positioning System), GLONASS or Galileo receiver.

In some embodiments the positioning sensor can be a cellular ID system or an assisted GPS system.

In some embodiments the apparatus 10 further comprises a direction or orientation sensor. The orientation/direction sensor can in some embodiments be an electronic compass, accelerometer, and a gyroscope or be determined by the motion of the apparatus using the positioning estimate.

It is to be understood again that the structure of the electronic device 10 could be supplemented and varied in many ways.

Figure 3:
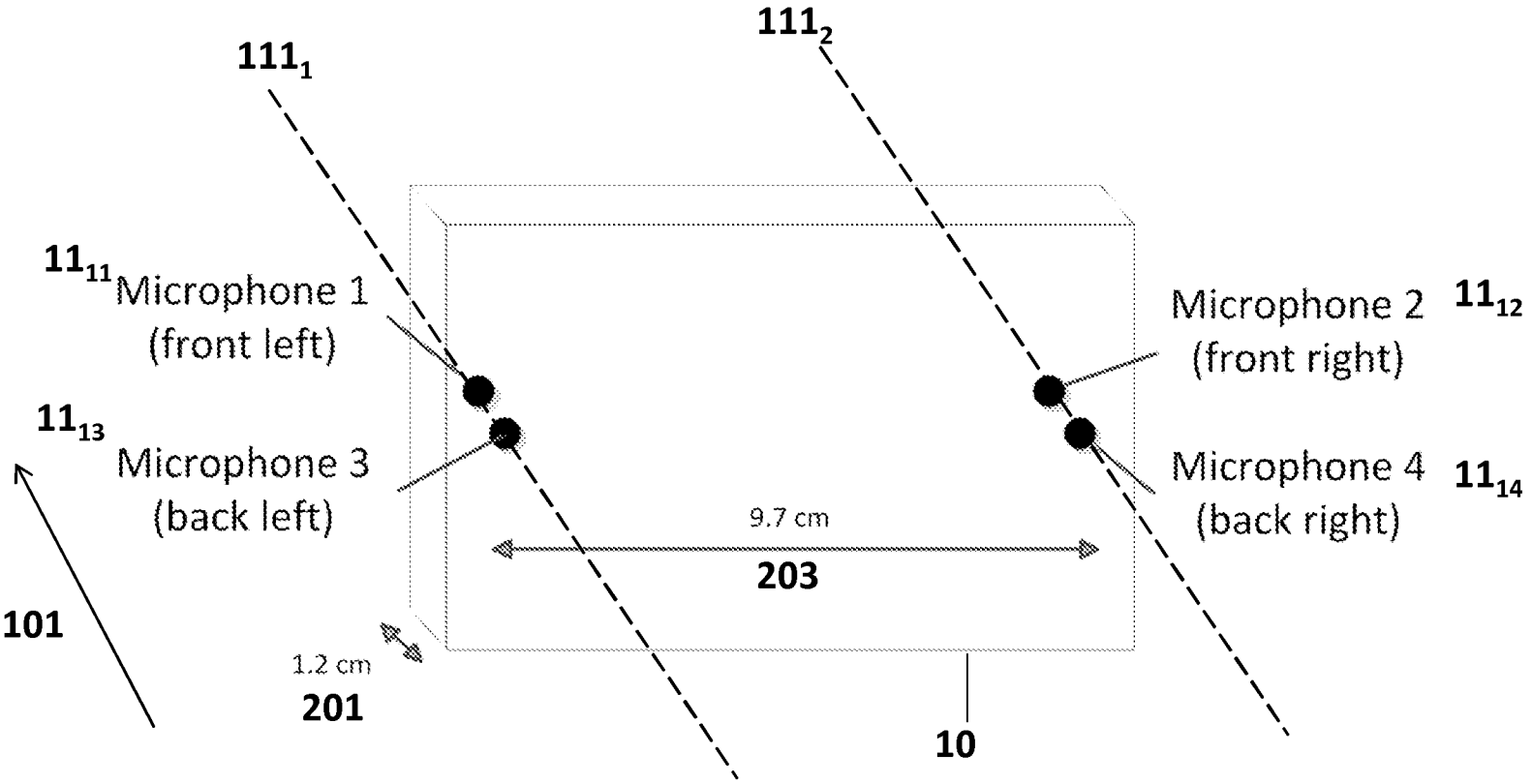
FIG. 3 shows schematically example microphone dimensions on apparatus according to some embodiments.

With respect to FIG. 3 an example apparatus implementation is shown wherein the apparatus 10 is approximately 9.7 cm wide 203 and approximately 1.2 cm deep 201. In the example shown in FIG. 3 the apparatus comprises four microphones a first (front left) microphone $\mathbf{11}_{11}$ located at the front left side of the apparatus, a front right microphone $\mathbf{11}_{12}$ located at the front right side of the apparatus, a back right microphone $\mathbf{11}_{14}$ located at the back right side of the apparatus, and a back left microphones $\mathbf{11}_{13}$ located at the back left side of the apparatus. The line $\mathbf{111}_1$ joining the front left $\mathbf{11}_{11}$ and back left $\mathbf{11}_{13}$ microphones and the line $\mathbf{111}_2$ joining the front right $\mathbf{11}_{12}$ microphone and the back right $\mathbf{11}_{14}$ can define a recording angle.

Figure 5:
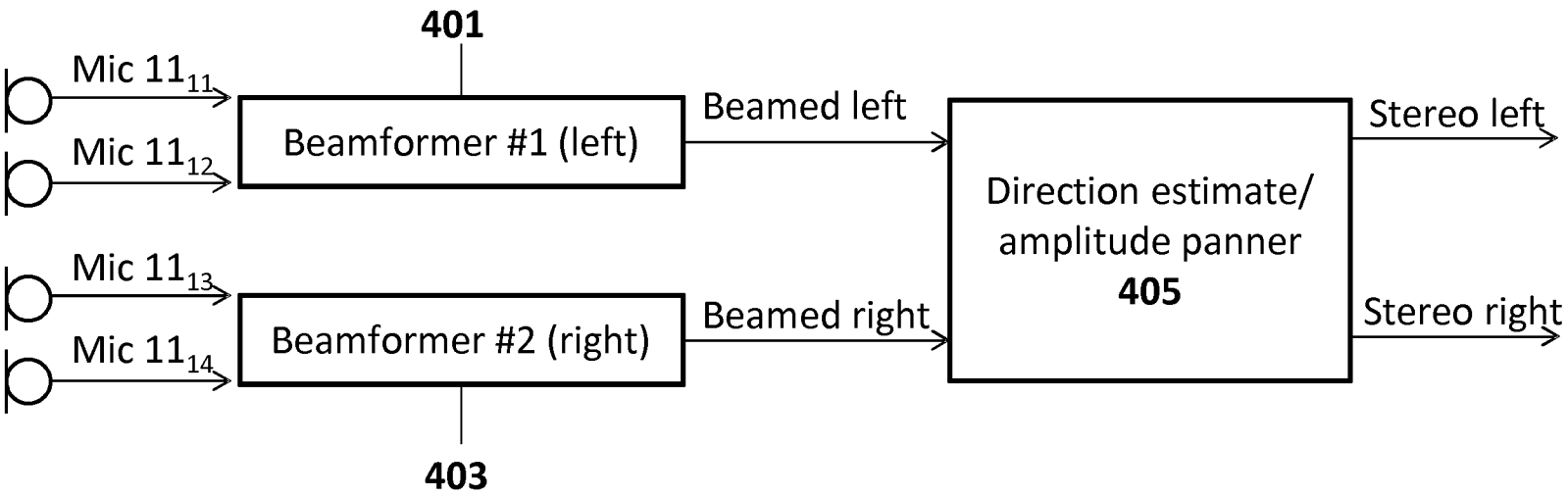
FIG. 5 shows schematically an example audio signal processing apparatus according to some embodiments.

With respect to FIG. 5, an example audio signal processing apparatus according to some embodiments is shown. Furthermore with respect to FIG. 6 a flow diagram of the operation of the audio signal processing apparatus as shown in FIG. 5 is shown.

In some embodiments the apparatus comprises the microphone or array of microphones configured to capture or record the acoustic waves and generate an audio signal for each microphone which is passed or input to the audio signal processing apparatus. As described herein in some embodiments the microphones 11 are configured to output an analogue signal which is converted into a digital format by the analogue to digital converter (ADC) 14. However the microphones shown in the example herein are integrated microphones configured to output a digital format signal directly to a beamformer.

In the example shown herein there are four microphones. These microphones can be arranged in some embodiments in a manner similar to that shown in FIG. 3. Therefore in some embodiments the apparatus comprises a first (front left) microphone $\mathbf{11}_{11}$ located at the front left side of the apparatus, a front right microphone $\mathbf{11}_{12}$ located at the front right side of the apparatus, a back right microphone $\mathbf{11}_{14}$ located at the back right side of the apparatus, and a back left microphones $\mathbf{11}_{13}$ located at the back left side of the apparatus. It would be understood that in some embodiments there can be more than or fewer than four microphones and the microphones can be arranged or located on the apparatus in any suitable manner.

Furthermore although as shown in FIG. 3 the microphones are part of the apparatus it would be understood that in some embodiments the microphone array is physically separate from the apparatus, for example the microphone array can be located on a headset (where the headset also has an associated video camera capturing the video images which can also be passed to the apparatus and processed in a manner to generate an encoded video signal which can incorporate the processed audio signals as described herein) which wirelessly or otherwise passes the audio signals to the apparatus for processing. It would be understood that in general the embodiments as described herein can be applied to audio signals for example audio signals which have been captured from microphones and then stored in memory. Thus in some embodiments in general can be configured to receive the at least two audio signals or the apparatus comprise an input configured to receive the at least two audio signals, which may originally be generated by the microphone array.

Figure 6:
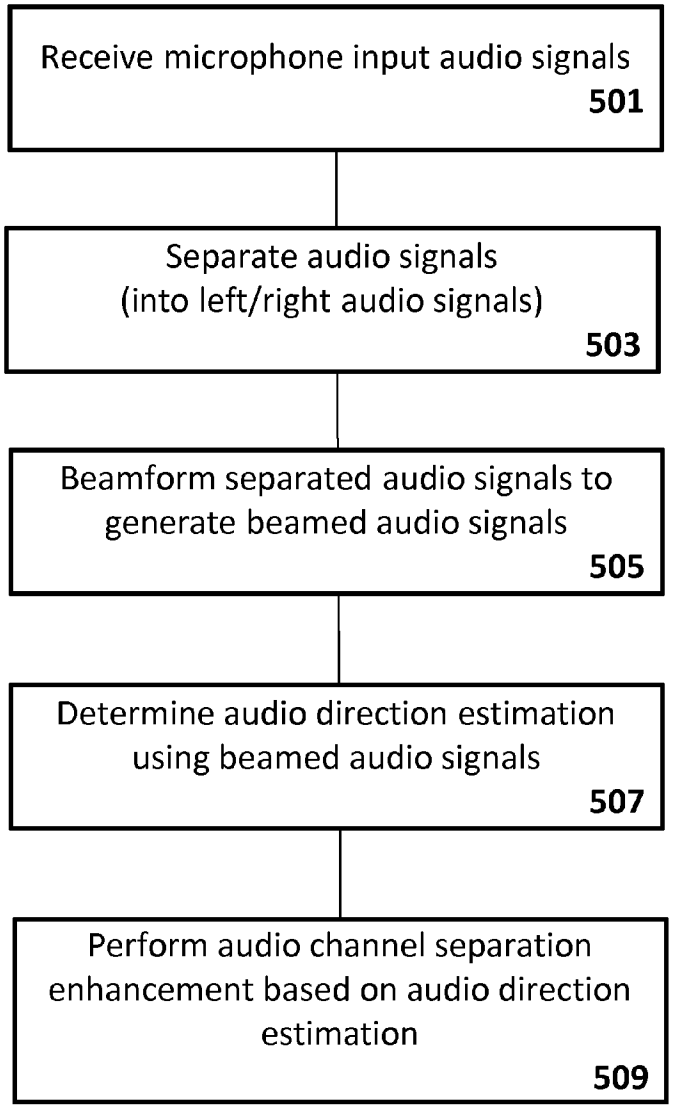
FIG. 6 shows schematically a flow diagram of the operation of the audio signal processing apparatus shown in FIG. 5 according to some embodiments.

The operation of receiving the microphone input audio signals is shown in FIG. 6 by step 501.

In some embodiments the apparatus comprises at least one beamformer or means for beamforming the microphone audio signals. In the example shown in FIG. 5 there comprises 2 beamformers, each of the beamformers configured to generate a separate beamformed audio signal. In the example shown herein the beamformers are configured to generate a left and a right beam however it would be understood that in some embodiments there can be any number of beamformers generating any number of beams. Furthermore in the embodiments described herein beamformers or means for beamforming the audio signals are described. However it would be understood that more generally audio formers or means for generating a formed audio signal can be employed in some embodiments. The audio formers or means for generating a formed audio signal can for example be a mixer configured to mix a selected group of the audio signals. In some embodiments the mixer can be configured to mix the audio signals such that the mixed audio signal creates an order gradient pattern with a defined direction. Thus in some embodiments there can be formed any number of order gradient patterns formed with defined directions by selecting audio signals from the multiple audio signals and mixing the selected audio signals.

In some embodiments the apparatus comprises a first (left) beamformer 401. The first (left) beamformer 401 can be configured to receive the audio signals from the left microphones. In other words the first beamformer 401 is configured to receive the audio signals from the front left microphone $\mathbf{11}_{11}$ and the rear left microphone $\mathbf{11}_{13}$.

Furthermore in some embodiments the apparatus comprises a second (right) beamformer 403. The second (right) beamformer 403 can be configured to receive the audio signals from the right microphones. In other words the second beamformer 403 can be configured to receive the audio signals from the front right microphone $\mathbf{11}_{12}$ and the rear right microphone $\mathbf{11}_{14}$.

In the example shown herein each beamformer is configured to receive a separate selection of the audio signals generated by the microphones. In other words the beamformers perform spatial filtering using the microphone audio signals.

The operation of separating the audio signals (and in this example into left and right audio signals) is shown in FIG. 6 by step 503.

The beamformers (in this example the first beamformer 401 and the second beamformer 403) in some embodiments can be configured to apply a beam filtering on the audio signals received to generate beamformed or beamed audio signals.

In some embodiments the beamformer can be configured to beamform the microphone audio signals using a time domain filter-and-sum beamforming approach. The time domain filter-and-sum approach can be mathematically described according to the following expression:

$$y(n) = \sum_{j=1}^{M} \sum_{k=0}^{L-1} h_j(k) x_j(n-k),$$

where M is the number of microphones and L is the filter length. Filter coefficients are denoted by $h_j(k)$ and the microphone signal by $x_j$. In the filter-and-sum beamforming, the filter coefficients $h_j(k)$ are determined regarding the microphone positions.

In some embodiments the filter coefficients $h_j(k)$ are chosen or determined so to enhance the audio signals from a specific direction. Furthermore in some embodiments the direction of enhancement is the line defined with the microphones as shown in FIG. 3 and thus produces a beam which has an emphasis on a frontal direction.

Although the beamformer is shown generating audio signal beams or beamed audio signals using time domain processing it would be also understood that in some embodiments the beamforming can be performed in the frequency or any other transformed domain.

The operation of beamforming the separated audio signals to generate beamed audio signals is shown in FIG. 6 by step 505.

Figure 7:
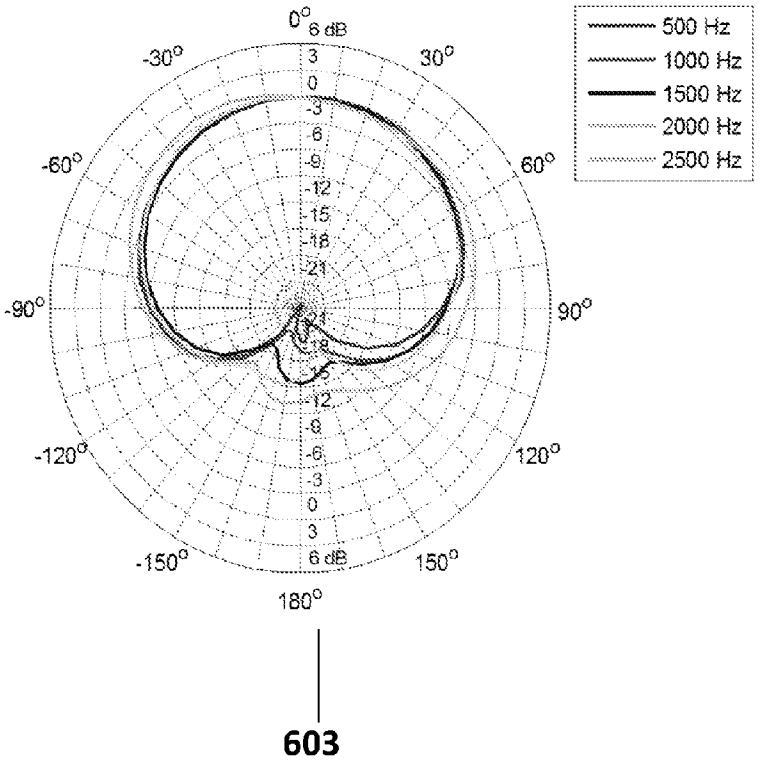
FIG. 7 shows polar gain plots of example beamforming of the left and right microphones according to some embodiments.
Figure 7:
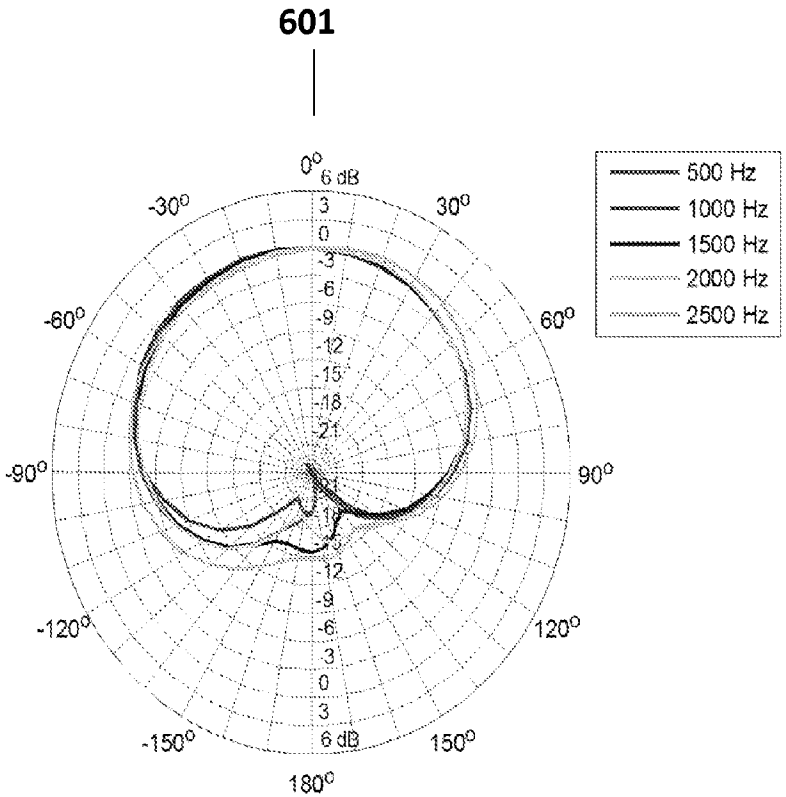

In some embodiments the beamformer can be configured to output the beamed audio signals (which in the example shown in FIG. 5 are the beamed left audio signal and beamed right audio signal) to the direction estimator/amplifier amplitude panner 405. The beam directivity plots for a first example beam pair is shown in FIG. 7. As can be seen from the figure, the beams attenuate sound coming from the back by approximately 10 dB below 3 kHz. Effectively the formed audio signals or beams 601 and 603 serve as virtual directional microphone signals. As described herein the beam design and thus the virtual microphone positions can be freely chosen. For example in the examples described herein we have chosen the virtual microphones to be approximately at the same positions as the original front left and front right microphones.

In some embodiments the apparatus comprises a direction estimator/amplitude panner 405 configured to receive the beamed audio signals. In the example shown in FIG. 5 as described herein two front emphasising beams are received, however it would be understood that any suitable number and directional beam can be received.

Figure 4:
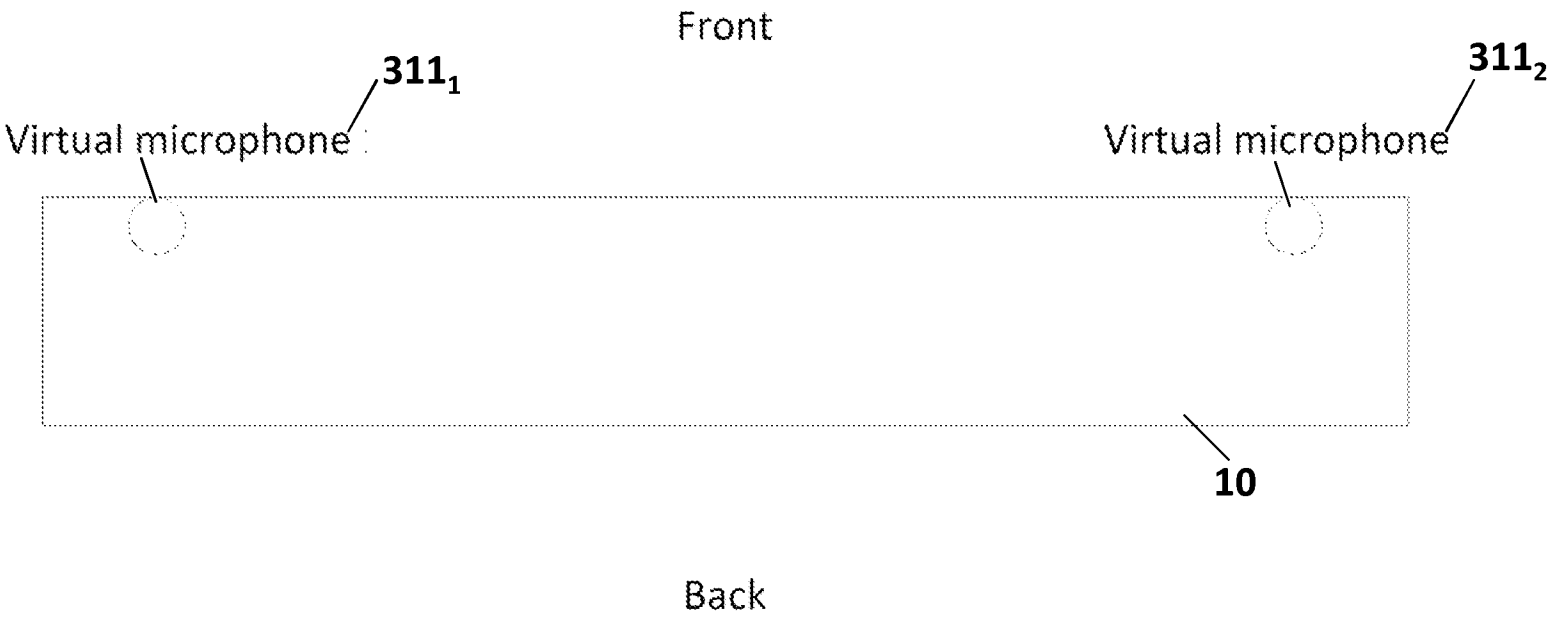
FIG. 4 shows schematically example virtual microphone locations on apparatus according to some embodiments.

In the example presented herein the beamed audio signals serve as left and right channels that provide an input to a direction estimation or spatial analysis performed by the direction estimator. In other words the beamed left and the right audio signals can be considered to the audio signals from a virtual left microphone $\mathbf{311}_1$ and a virtual right microphone $\mathbf{311}_2$ such as shown in FIG. 4 where the schematic representation of the example apparatus has a left virtual microphone and right virtual microphone marked. In some embodiments the direction estimator/amplitude panner 405 can more generally be considered to comprise an audio analyser (or means for analysing the formed audio signals) and be configured to estimate a modelled audio source direction and associated audio source signal.

An example spatial analysis, determination of sources and parameterisation of the audio signal is described as follows. However it would be understood that any suitable audio signal spatial or directional analysis in either the time or other representational domain (frequency domain etc.) can be used.

In some embodiments the direction estimator/amplitude panner 405 comprises a framer. The framer or suitable framer means can be configured to receive the audio signals from the virtual microphones (in other words the beamed audio signals) and divide the digital format signals into frames or groups of audio sample data. In some embodiments the framer can furthermore be configured to window the data using any suitable windowing function. The framer can be configured to generate frames of audio signal data for each microphone input wherein the length of each frame and a degree of overlap of each frame can be any suitable value. For example in some embodiments each audio frame is 20 milliseconds long and has an overlap of 10 milliseconds between frames. The framer can be configured to output the frame audio data to a Time-to-Frequency Domain Transformer.

In some embodiments the direction estimator/amplitude panner 405 comprises a Time-to-Frequency Domain Transformer. The Time-to-Frequency Domain Transformer or suitable transformer means can be configured to perform any suitable time-to-frequency domain transformation on the frame audio data. In some embodiments the Time-to-Frequency Domain Transformer can be a Discrete Fourier Transformer (DFT). However the Transformer can be any suitable Transformer such as a Discrete Cosine Transformer (DCT), a Modified Discrete Cosine Transformer (MDCT), a Fast Fourier Transformer (FFT) or a quadrature mirror filter (QMF). The Time-to-Frequency Domain Transformer can be configured to output a frequency domain signal for each microphone input to a sub-band filter.

In some embodiments the direction estimator/amplitude panner 405 comprises a sub-band filter. The sub-band filter or suitable means can be configured to receive the frequency domain signals from the Time-to-Frequency Domain Transformer for each microphone and divide each beamed (virtual microphone) audio signal frequency domain signal into a number of sub-bands.

The sub-band division can be any suitable sub-band division. For example in some embodiments the sub-band filter can be configured to operate using psychoacoustic filtering bands. The sub-band filter can then be configured to output each domain range sub-band to a direction analyser.

In some embodiments the direction estimator/amplitude panner 405 can comprise a direction analyser. The direction analyser or suitable means can in some embodiments be configured to select a sub-band and the associated frequency domain signals for each beam (virtual microphone) of the sub-band.

The direction analyser can then be configured to perform directional analysis on the signals in the sub-band. The directional analyser can be configured in some embodiments to perform a cross correlation between the microphone/decoder sub-band frequency domain signals within a suitable processing means.

In the direction analyser the delay value of the cross correlation is found which maximises the cross correlation of the frequency domain sub-band signals. This delay can in some embodiments be used to estimate the angle or represent the angle from the dominant audio signal source for the sub-band. This angle can be defined as $\alpha$. It would be understood that whilst a pair or two beam audio signals from virtual microphones can provide a first angle, an improved directional estimate can be produced by using more than two virtual microphones and preferably in some embodiments more than two virtual microphones on two or more axes.

The directional analyser can then be configured to determine whether or not all of the sub-bands have been selected. Where all of the sub-bands have been selected in some embodiments then the direction analyser can be configured to output the directional analysis results. Where not all of the sub-bands have been selected then the operation can be passed back to selecting a further sub-band processing step.

The above describes a direction analyser performing an analysis using frequency domain correlation values. However it would be understood that the direction analyser can perform directional analysis using any suitable method. For example in some embodiments the object detector and separator can be configured to output specific azimuth-elevation values rather than maximum correlation delay values. Furthermore in some embodiments the spatial analysis can be performed in the time domain.

In some embodiments this direction analysis can therefore be defined as receiving the audio sub-band data;

$$X_k^b(n)=X_k(n_b+n), n=0, \ldots, n_{b+1}-n_b-1 \quad b=0, \ldots, B-1$$

where $n_b$ is the first index of bth subband. In some embodiments for every subband the directional analysis as described herein as follows. In some embodiments the direction is estimated with two virtual microphone or beamed audio channels. The direction analyser finds delay $\tau_b$ that maximizes the correlation between the two virtual microphone of beamed audio channels for subband b. DFT domain representation of e.g. $X_k^b(n)$ can be shifted $\tau_b$ time domain samples using $$X_{k,\tau_b}^b(n) = X_k^b(n)e^{-j\frac{2\pi n\tau_b}{N}}$$

The optimal delay in some embodiments can be obtained from $$\tau_{b,max} = \underset{\tau_b \in [-D_{max}, D_{max}]}{\operatorname{argmax}} \left\{ \operatorname{Re}\left( \sum_{n=0}^{n_{b+1}-n_b-1} \left( X_{2,\tau_b}^b(n) * X_3^b(n) \right) \right) \right\}$$

where Re indicates the real part of the result and * denotes complex conjugate. $X_{2,\tau b}^{\ b}$ and $X_2^{\ b}$ are considered vectors with length of $n_{b+1}-n_b$ samples. The direction analyser can in some embodiments implement a resolution of one time domain sample for the search of the delay.

In some embodiments the direction analyser can be configured to generate a sum signal. The sum signal can be mathematically defined as.

$$X_{sum}^b = \begin{cases} \left(X_{2,\tau_b}^b + X_3^b\right)/2 & \tau_b \le 0 \\ \left(X_2^b + X_{3,-\tau_b}^b\right)/2 & \tau_b > 0 \end{cases}$$

In other words the direction analyser is configured to generate a sum signal where the content of the channel in which an event occurs first is added with no modification, whereas the channel in which the event occurs later is shifted to obtain best match to the first channel.

It would be understood that the delay or shift $\tau_b$ indicates how much closer the sound source is to one virtual microphone (or beamed audio channel) than another virtual microphone (or beamed audio channel). The direction analyser can be configured to determine actual difference in distance as $$\Delta_{23} = \frac{v\tau_b}{F_s}$$

where Fs is the sampling rate of the signal and v is the speed of the signal in air (or in water if we are making underwater recordings).

The angle of the arriving sound is determined by the direction analyser as, $$\dot{\alpha} = \pm\cos^{-1}\left(\frac{\Delta_{23}^2 + 2b\Delta_{23} - d^2}{2db}\right)$$

where d is the distance between the pair of virtual microphones/beamed audio channel separation and b is the estimated distance between sound sources and nearest microphone. In some embodiments the direction analyser can be configured to set the value of b to a fixed value. For example b=2 meters has been found to provide stable results.

It would be understood that the determination described herein provides two alternatives for the direction of the arriving sound. In some embodiments the direction estimator/amplitude panner 405 can be configured to select the audio source location which is towards the virtual microphone which receives the signal first. In other words the strength of the correlation of the virtual microphone audio signals determines which of the two alternatives are selected.

In some embodiments the direction analyser can be configured to use audio signals from a third beamed channel or a third virtual microphone to define which of the signs in the determination is correct. If we assume that the microphones determine an equilateral triangle, the distances between the third beamed channel or virtual microphone and the two estimated sound sources are:

$$\delta_b^+ = \sqrt{(h+b\sin(\dot{\alpha}_b))^2+(d/2+b\cos(\dot{\alpha}_b))^2}$$

$$\delta_b^- = \sqrt{(h-b\sin(\dot{\alpha}_b))^2+(d/2+b\cos(\dot{\alpha}_b))^2}$$

where h is the height of an equilateral triangle, i.e.

$$h = \frac{\sqrt{3}}{2}d.$$

The distances in the above determination can be considered to be equal to delays (in samples) of;

$$\tau_b^+ = \frac{\delta^+ - b}{v}F_s$$

$$\tau_b^- = \frac{\delta^- - b}{v}F_s$$

Out of these two delays the direction analyser in some embodiments is configured to select the one which provides better correlation with the sum signal. The correlations can for example be represented as $$c_b^+ = \mathrm{Re}\left(\sum_{n=0}^{n_{b+1}-n_b-1} \left(X_{sum,\tau_b^+}^b(n) * X_1^b(n)\right)\right)$$

$$c_b^- = \mathrm{Re}\left(\sum_{n=0}^{n_{b+1}-n_b-1} \left(X_{sum,\tau_b^-}^b(n) * X_1^b(n)\right)\right)$$

The direction analyser can then in some embodiments then determine the direction of the dominant sound source for subband b as:

$$\alpha_b = \begin{cases} \dot{\alpha}_b & c_b^+ \geq c_b^- \\ -\dot{\alpha}_b & c_b^+ < c_b^- \end{cases}$$

In some embodiments the direction estimator/amplitude panner 405 can further comprises a mid/side signal generator. The main content in the mid signal is the dominant sound source found from the directional analysis. Similarly the side signal contains the other parts or ambient audio from the generated audio signals. In some embodiments the mid/side signal generator can determine the mid M and side S signals for the sub-band according to the following equations:

$$M^b = \begin{cases} \left(X_{2,\tau_b}^b + X_3^b\right)/2 & \tau_b \leq 0 \\ \left(X_2^b + X_{3,-\tau_b}^b\right)/2 & \tau_b > 0 \end{cases}$$

$$S^b = \begin{cases} \left(X_{2,\tau_b}^b - X_3^b\right)/2 & \tau_b \leq 0 \\ \left(X_2^b - X_{3,-\tau_b}^b\right)/2 & \tau_b > 0 \end{cases}$$

It is noted that the mid signal M is the same signal that was already determined previously and in some embodiments the mid signal can be obtained as part of the direction analysis. The mid and side signals can be constructed in a perceptually safe manner such that the signal in which an event occurs first is not shifted in the delay alignment. The mid and side signals can be determined in such a manner in some embodiments is suitable where the microphones are relatively close to each other. Where the distance between the microphones is significant in relation to the distance to the sound source then the mid/side signal generator can be configured to perform a modified mid and side signal determination where the channel is always modified to provide a best match with the main channel.

The mid (M), side (S) and direction (α) components can then in some embodiments be passed to the amplitude panner part of the direction estimator/amplitude panner 405.

The analysis of the beamed audio signal to determine audio or sound source(s) or objects is shown in FIG. 6 by step 507.

In some embodiments of the directional component(s) (a) can then be used to control the synthesis of multichannel audio signals for audio panning.

For example in some embodiments the direction estimator/amplitude panner 405 can be configured to divide the directional component into left and right synthesis channels using amplitude panning. For example, if the sound is estimated to come from the left side, the amplitude of the left side signal is amplified in relation to the right side signal. The ambience component is fed into both output channels, but for that part the outputs of the two channels are decorrelated to increase the spatial feeling.

Figure 8:
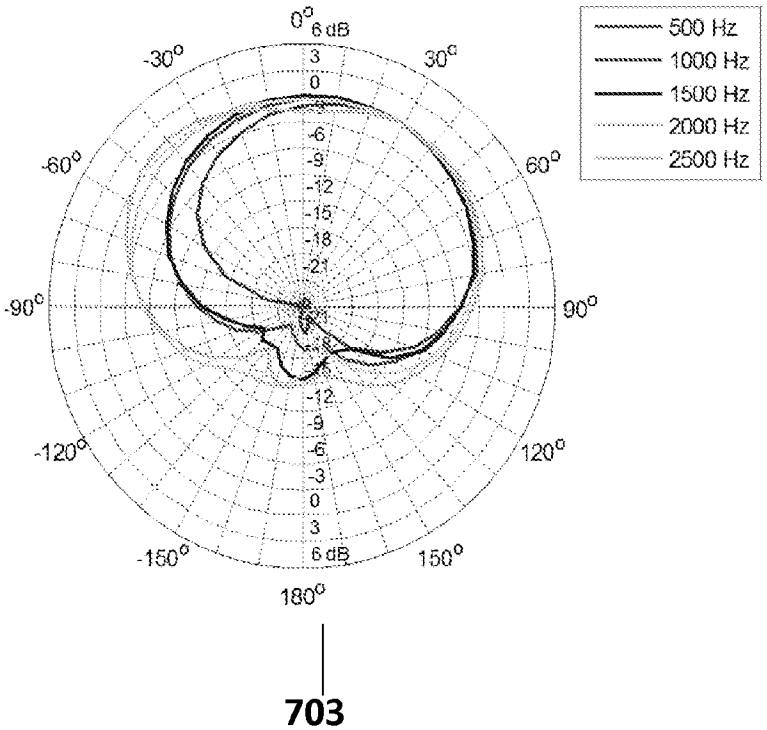
FIG. 8 shows polar gain plots of example processed beamformed left and right microphones according to some embodiments.
Figure 8:
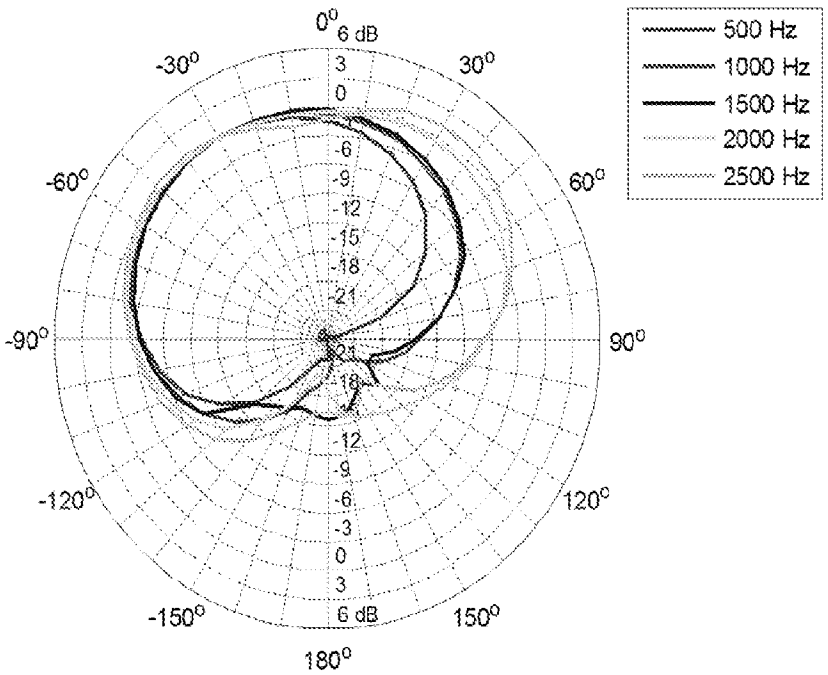
Figure 9:
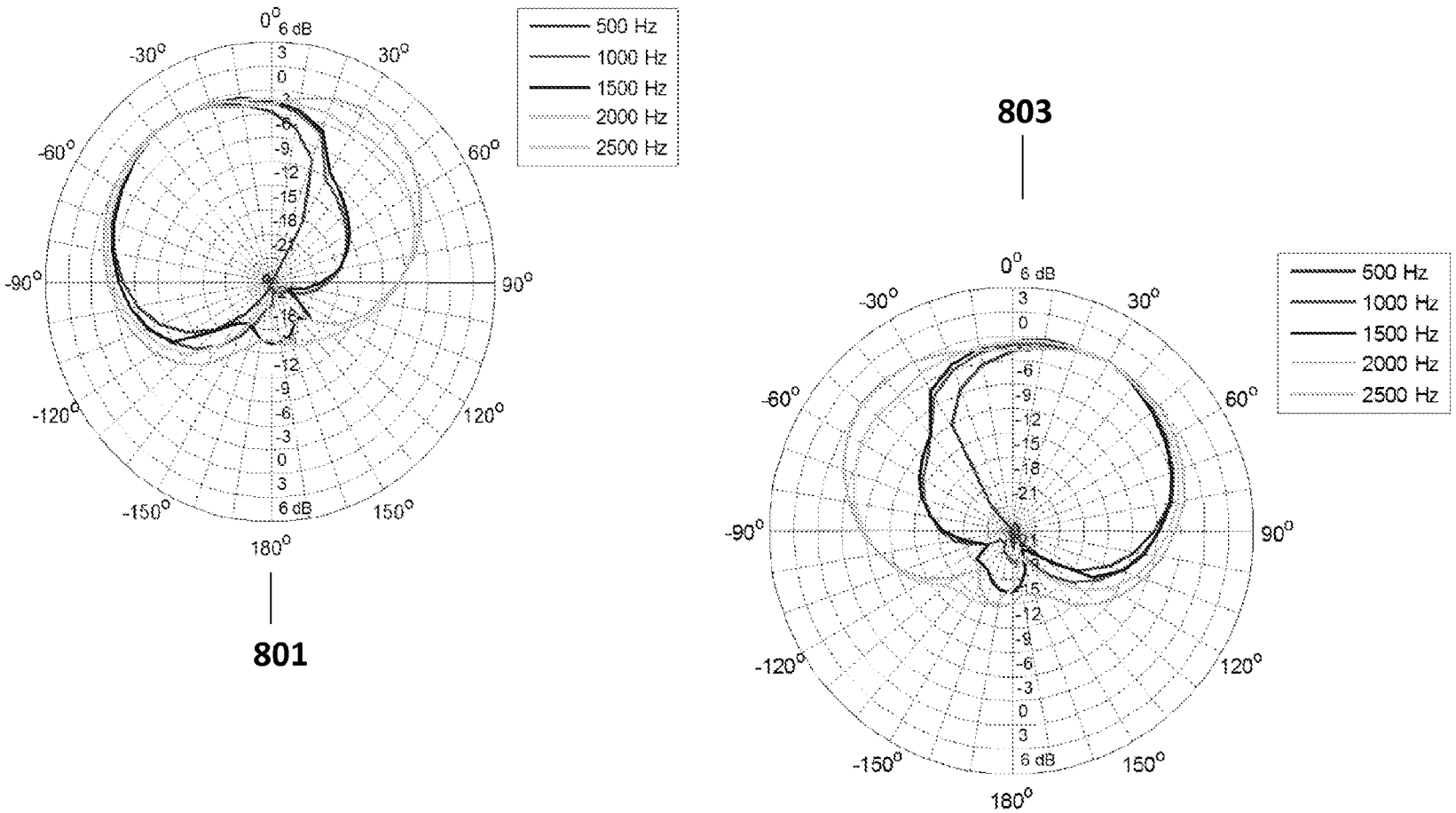
FIG. 9 shows polar gain plots of a further example beamformed left and right microphones according to some embodiments.

The directivity plots of the example stereo channels after the direction estimation and amplitude panning algorithm are shown in FIG. 8 which shows channels 701 and 703 which are spaced further apart for the lower frequencies. Furthermore another version of the processed output channels with a wider stereo picture are shown in FIG. 9 in the left channel 801 and right channel 803 plots.

In some embodiments the direction estimator/amplitude panner 405 can comprise an audio signal synthesiser (or means for synthesising an output signal) to generate suitable output audio signals or channels. For example in some embodiments the direction estimator/amplitude panner 405 can be configured to synthesise a left and right audio signal or channel based on the mid and side components. For example a head related transfer function or similar can be applied to the mid side components and their associated directional components to synthesise a left and right output channel audio signal. Furthermore in such embodiments the ambience (or side) component can be added to both output channel audio signals. In some embodiments it would be understood that enhanced stereo separation can be achieved by applying a displacement factor to the directional component prior to applying the head related transfer function. In some embodiments this displacement factor can be an additive factor. For example $$\alpha' = \alpha + x \text{ when } \alpha > 0$$

$$\alpha' = \alpha - x \text{ when } \alpha < 0$$

where α' is the modified directional component, α the input directional component and x is the modification factor (for example 10-20 degrees) and α=0 is where the audio source is located directed in front of the camera. The additive (subtractive) factor can be any suitable value and although shown as a fixed value can in some embodiments be a function of the value of a and furthermore be a function of the sub-band. For example in some embodiments the lower frequencies are not shifted or shifted by smaller amounts than the higher frequencies.

In some embodiments the displacement factor is any other modification factor such as for example a linear multiplication, or a non-linear mapping of the source directions based on the directional component. For example α'=f(α), where f(α) is a linear or non linear function of α.

Figure 14:
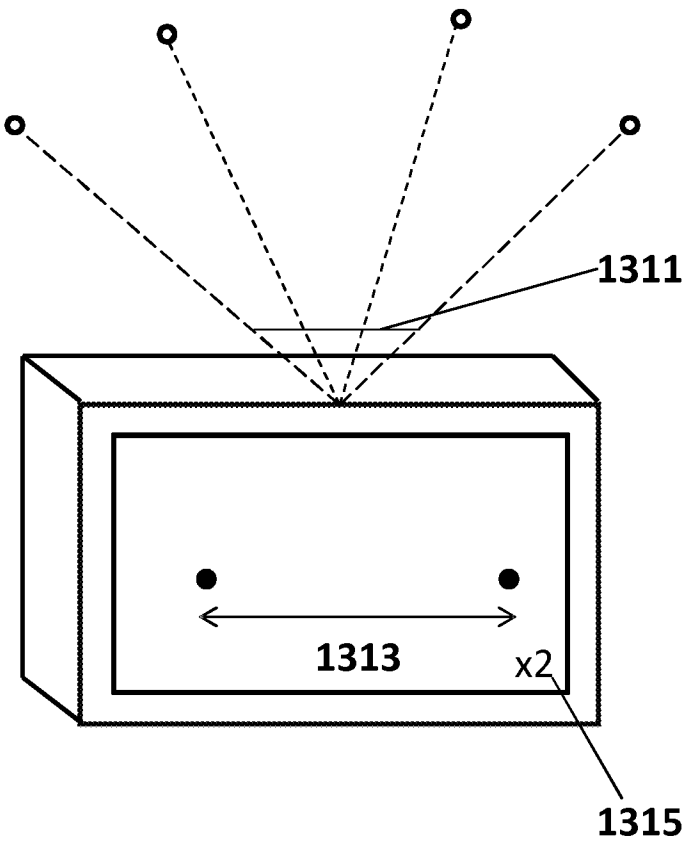
FIG. 14 shows a schematic view of an example zoom based audio signal processing example.
Figure 14:
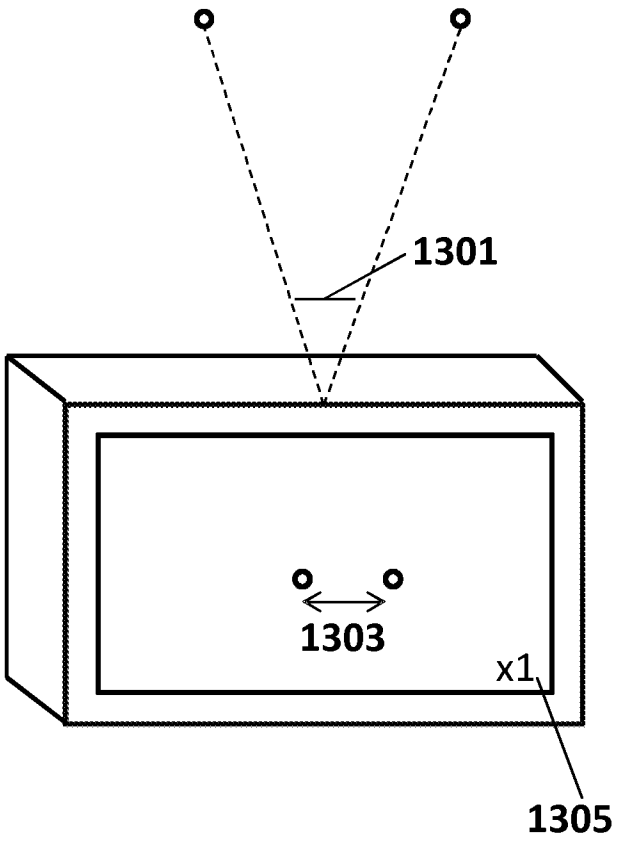

In some embodiments the synthesis of the audio channels can further be determined based on a further component. For example in some embodiments the directional component of the audio sources is further modified by the display zoom or camera zoom factor. For example in some embodiments the stereo separation effect is increased based on the display zoom or camera zoom function. In other words, the higher the zoom factor and thus the 'closer' to a distant object as displayed, the wider the stereo separation effect to attempt to match the displayed image. An example of this is shown in FIG. 14 where on the left hand side two objects with a first audio separation angle 1303 (in other words directional components) are shown on the display with a first distance separation 1303 with a first zoom factor 1305. On the right hand side of FIG. 14 the same two objects are shown on the display with a second distance separation 1313 with a second (and higher) zoom factor 1315 which causes the direction estimator/amplitude panner 405 to modify the stereo separation of the audio source such that they have a second audio separation angle 1311. This separation can be achieved by a suitable manner such as described herein by the amplitude panning or directional component modification and audio synthesis methods.

The operation of performing audio channel separation enhancement based on the audio direction estimation is shown in FIG. 6 by step 509.

Figure 10:
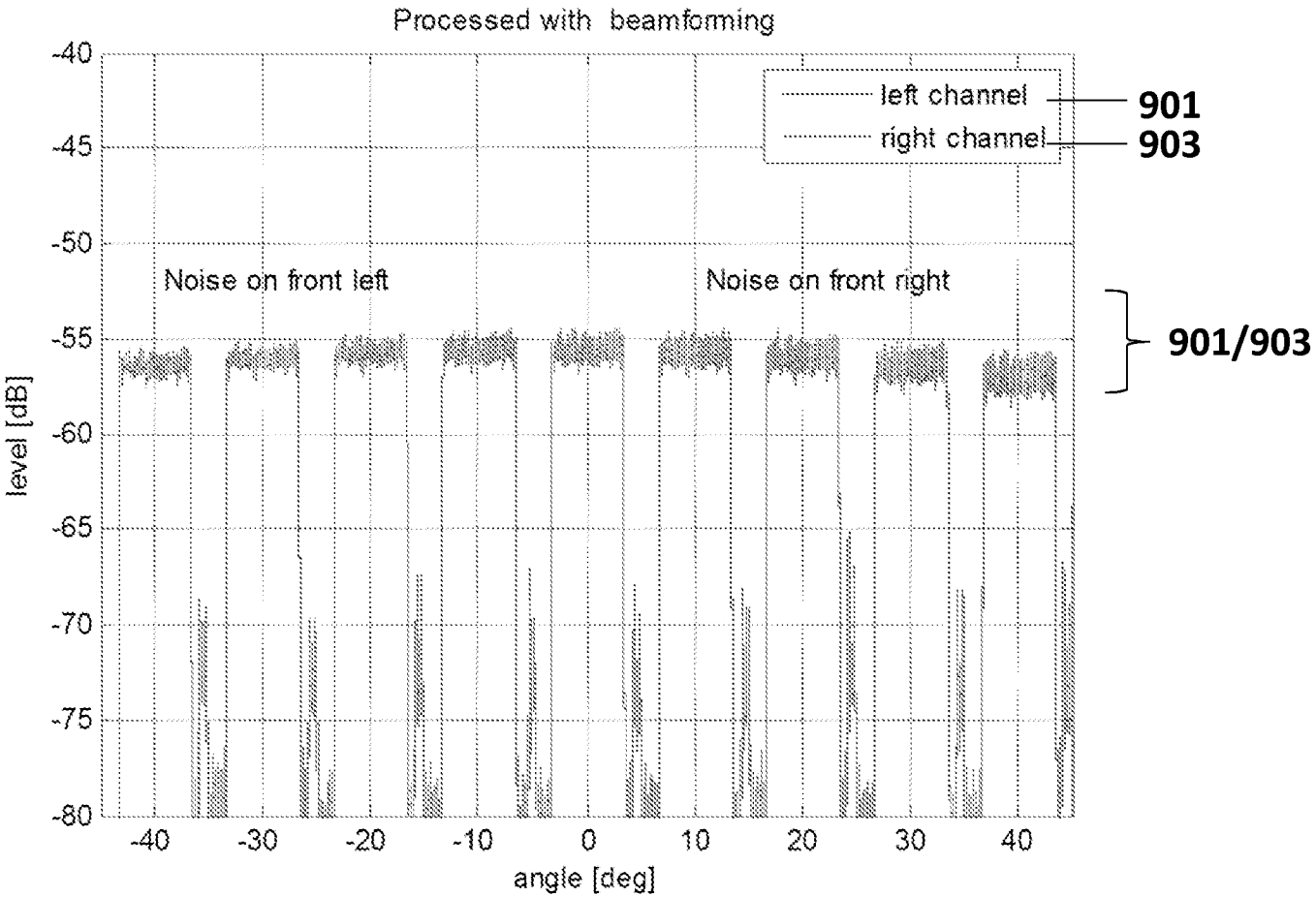
FIG. 10 shows a graphical plot of beamformed noise bursts originating from the left and right directions according to some embodiments.
Figure 11:
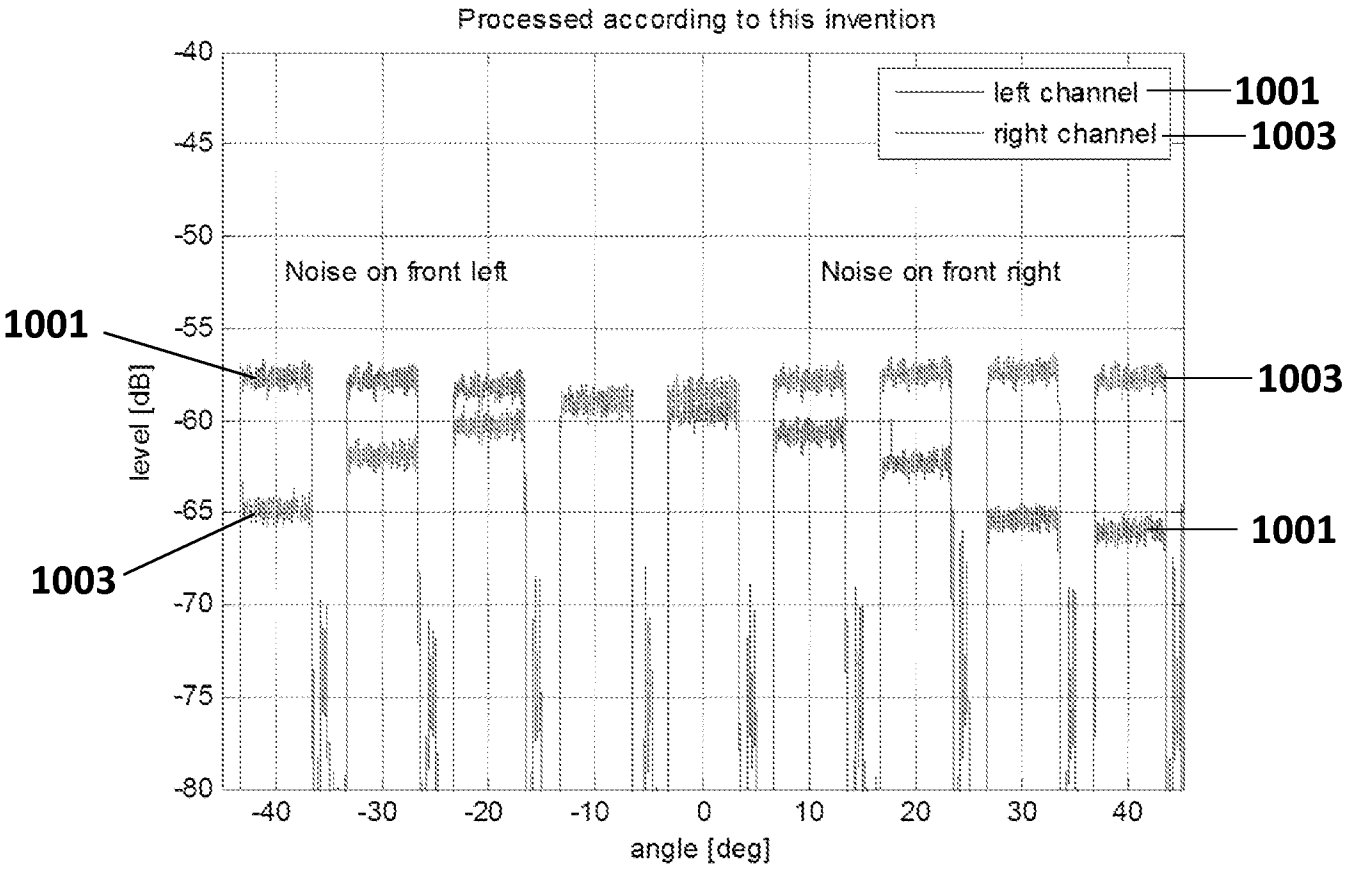
FIG. 11 shows a graphical plot of processed beamformed noise bursts originating from the left and right directions according to some embodiments.
Figure 12:
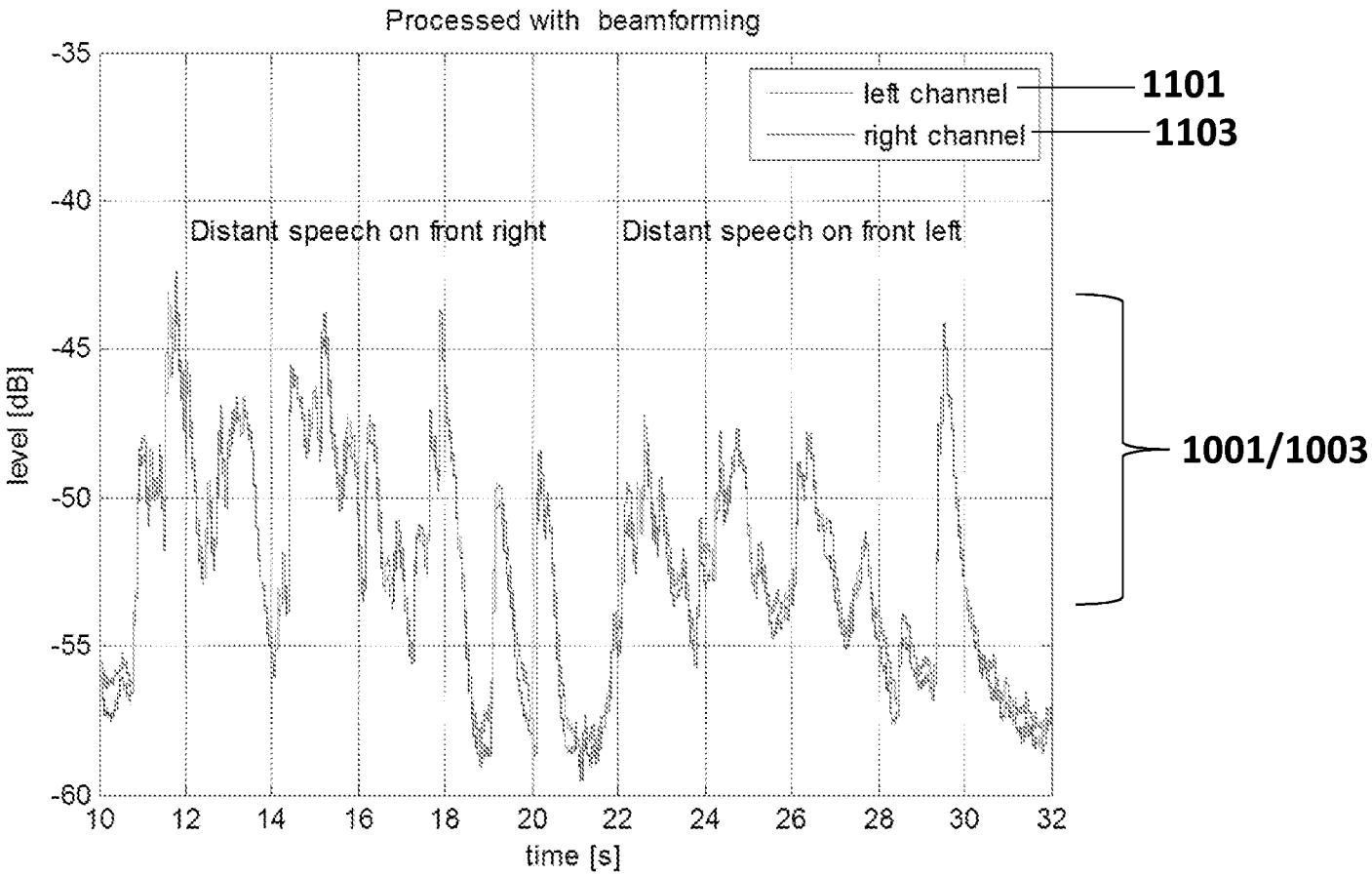
FIG. 12 shows a graphical plot of beamformed distant speech originating from the left and right directions.
Figure 13:
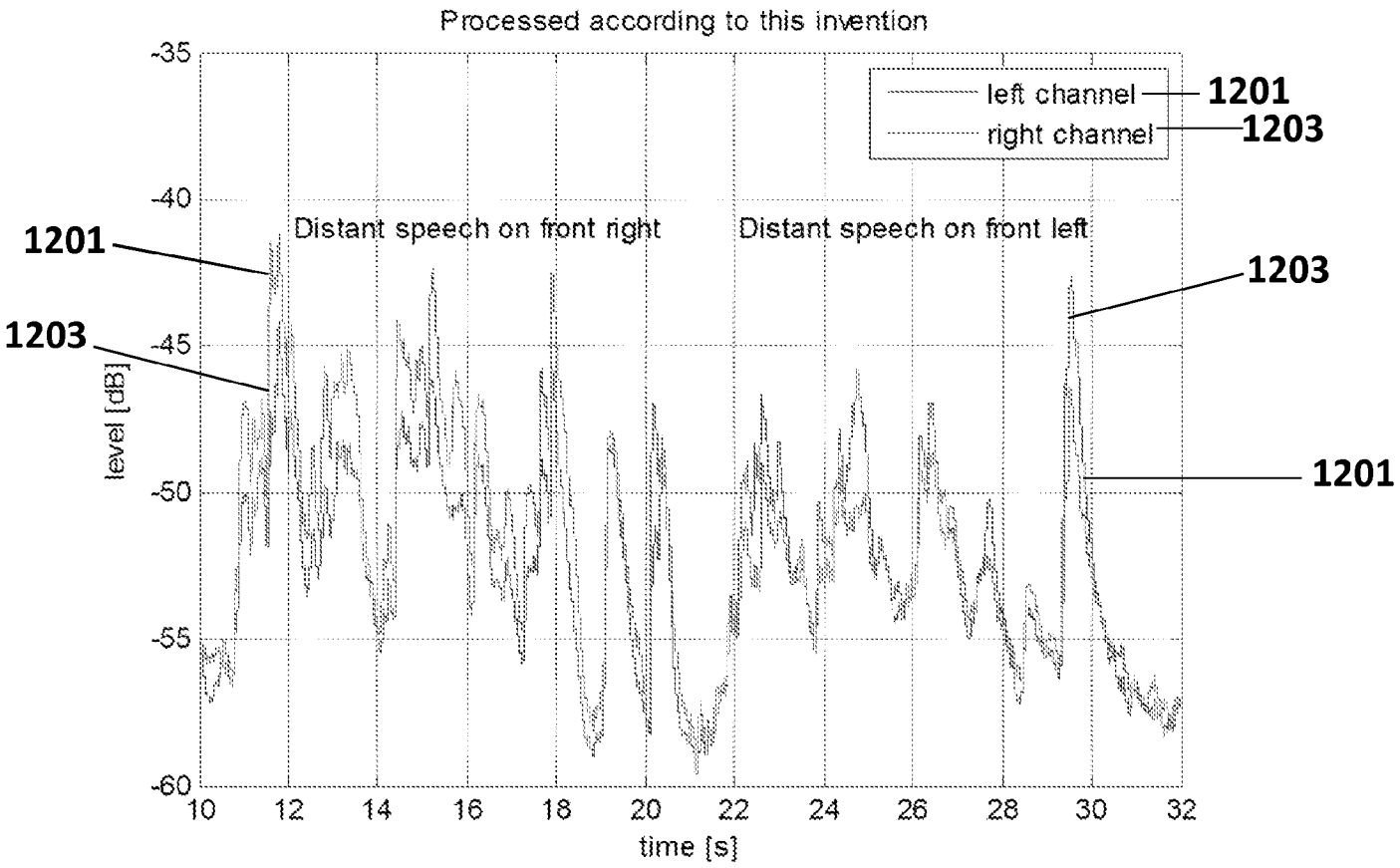
FIG. 13 shows a graphical plot of processed beamformed distant speech originating from the left and right directions.

FIGS. 10 and 11 show an application of some embodiments to stereo recording. FIG. 10 shows the output levels of noise levels for noise from the front left 901 and front right 903 virtual channels after the beamformer. There is no level difference between the left and right channels while recording noise from front right or front left directions. FIG. 11 shows the outputs processed according to some embodiments where the output right channel 1003 has higher level during noise from the front right direction and the left channel 1001 has higher level during noise from the front left direction. Similarly FIG. 12 and FIG. 13 illustrate the level differences between the left and right channels with distant voice inputs from different angles. FIG. 12 shows the output levels of speech levels for from the front left 1101 and front right 1103 virtual channels after the beamformer. There is no level difference between the left and right channels while recording speech from front right or front left directions. FIG. 13 shows the outputs processed according to some embodiments where the output right channel 1203 has higher level during speech from the front right direction and the left channel 1201 has higher level during speech from the front left direction.

The direction estimator/amplitude panner 405 can then in some embodiments output the synthesised channels to generate suitable mono, stereo or multichannel outputs dependent on the required output format. In the example shown in FIG. 5 a stereo output format is shown with the direction estimator/amplitude panner 405 generating a stereo left channel audio signal and stereo right channel audio signal.

It shall be appreciated that the term user equipment is intended to cover any suitable type of wireless user equipment, such as mobile telephones, portable data processing devices or portable web browsers, as well as wearable devices.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

receiving at least two groups of at least two audio signals wherein the at least two audio signals for each group are provided from at least two closely spaced microphones;

generating a first formed audio signal from a first of the at least two groups of the at least two audio signals towards a recording direction;

generating a second formed audio signal from the second of the at least two groups of the at least two audio signals towards the same recording direction;

analysing the first formed audio signal and the second formed audio signal to estimate a direction of at least one audio source and determine an associated audio source signal; and generating at least one output audio signal based on the associated audio source signal.

2. The method as claimed in claim 1, wherein the first group of the at least two audio signals are a front left and back left microphone; and generating the first formed audio signal from the first of the at least two groups of the at least two audio signals comprises generating a virtual left microphone signal.

3. The method as claimed in claim 1, wherein the second group of the at least two audio signals are a front right and back right microphone; and generating the second formed audio signal from the second of the at least two groups of the at least two audio signals comprises generating a virtual right microphone signal.

4. The method as claimed in claim 1, wherein analysing the first formed audio signal and the second formed audio signal to determine at least one audio source and the associated audio source signal comprises determining at least one source location.

5. The method as claimed in claim 4, further comprising:

receiving a source displacement factor; and processing the at least one source location by the source displacement factor such that the source location is displaced away from the audio mid-line by the source displacement factor.

6. The method as claimed in claim 5, wherein receiving the source displacement factor can comprise generating the source displacement factor based on a zoom factor associated with a camera configured to capture at least one frame image substantially when receiving the at least two groups of the at least two audio signals.

7. The method as claimed in claim 4, wherein generating at least one output audio signal based on the at least one audio source and the associated audio source signal comprises generating the at least one output audio signal based on the at least one audio source location.

8. The method as claimed in claim 7, wherein generating the at least one output audio signal based on the at least one audio source location comprises: determining at least-one output audio signal location; and audio panning the at least one audio source signal based on the at least one audio source location to generate the at least one output audio signal at the at least one output audio signal location.

9. The method as claimed in claim 1, wherein generating the first formed audio signal from the first of the at least two groups of the at least two audio signals comprises generating a first beamformed audio signal from the first of the at least two groups of the at least two audio signals; and generating the second formed audio signal from the second of the at least two groups of the at least two audio signals comprises generating a second beamformed audio signal from the second of the at least two groups of the at least two audio signals.

10. The method as claimed in claim 1, wherein generating the first formed audio signal from the first of the at least two groups of the at least two audio signals comprises generating a first mixed audio signal from the first of the at least two groups of the at least two audio signals such that the first mixed audio signal creates a first order gradient pattern with a first direction; and generating the second formed audio signal from the second of the at least two groups of the at least two audio signals comprises generating a second mixed audio signal from the second of the at least two groups of the at least two audio signals such that the second mixed audio signal creates a further first order gradient pattern with a second direction.

11. The method as claimed in claim 1, wherein the analyzing further comprises analyzing the first formed audio signal and the second formed audio signal to estimate a direction of at least one audio source in the recording direction.

12. An apparatus comprising at least one processor and at least one memory including computer code for one or more programs, the at least one memory and the computer code configured to with the at least one processor cause the apparatus to at least:

receive at least two groups of at least two audio signals wherein the at least two audio signals for each group are provided from at least two closely spaced microphones;

generate a first formed audio signal from a first of the at least two groups of the at least two audio signals towards a recording direction;

generate a second formed audio signal from the second of the at least two groups of the at least two audio signals towards the same recording direction;

analyse the first formed audio signal and the second formed audio signal to estimate a direction of at least one audio source and determine an associated audio source signal; and generate at least one output audio signal based on the associated audio source signal.

13. The apparatus as claimed in claim 12, wherein the first group of the at least two audio signals are a front left and back left microphone; and generating the first formed audio signal from the first of the at least two groups of the at least two audio signals causes the apparatus to generate a virtual left microphone signal.

14. The apparatus as claimed in claim 12, wherein the second group of the at least two audio signals are a front right and back right microphone; and generating the second formed audio signal from the second of the at least two groups of the at least two audio signals causes the apparatus to generate a virtual right microphone signal.

15. The apparatus as claimed in claim 12, wherein analysing the first formed audio signal and the second formed audio signal to determine at least one audio source and the associated audio source signal causes the apparatus to determine at least one source location.

16. The apparatus as claimed in claim 15, further causes to: receive a source displacement factor; and process the at least one source location by the source displacement factor such that the source location is displaced away from the audio mid-line by the source displacement factor.

17. The apparatus as claimed in claim 16, wherein receiving the source displacement factor causes the apparatus to generate the source displacement factor based on a zoom factor associated with a camera configured to capture at least one frame image substantially when receiving the at least two groups of the at least two audio signals.

18. The apparatus as claimed in claim 15, wherein generating at least one output audio signal based on the at least one audio source and the associated audio source signal causes the apparatus to generate the at least one output audio signal based on the at least one audio source location.

19. The apparatus as claimed in claim 18, wherein generating the at least one output audio signal based on the at least one audio source location causes the apparatus to: determine at least one output audio signal location; and audio pan the at least one audio source signal based on the at least one audio source location to generate the at least one output audio signal at the at least one output audio signal location.

20. An apparatus comprising:

an input configured to receive at least two groups of at least two audio signals wherein the at least two audio signals for each group are provided from at least two closely spaced microphones;

a first audio former configured to generate a first formed audio signal from a first of the at least two groups of the at least two audio signals towards a recording direction;

a second audio former configured to generate a second formed audio signal from the second of the at least two groups of the at least two audio signals towards the same recording direction;

an audio analyser configured to analyse the first formed audio signal and the second formed audio signal to estimate a direction of at least one audio source and determine an associated audio source signal; and an audio signal synthesiser configured to generate at least one output audio signal based on the associated audio source signal.

21. The apparatus as claimed in claim 20, wherein the audio signal synthesiser comprises: an output location determiner configured to determine at least one output audio signal location; and an amplitude panner configured to pan the at least one audio source signal based on the at least one audio source location to generate the at least one output audio signal at the at least one output audio signal location.

* * * * *